United States Patent [19]

Brüning

[11] Patent Number: 4,869,403

[45] Date of Patent: Sep. 26, 1989

[54] CARTRIDGE FOR PASTY MATERIALS

[75] Inventor: Werner Brüning, Engelskirchen, Fed. Rep. of Germany

[73] Assignee: Alfred Fischbach KG, Fed. Rep. of Germany

[21] Appl. No.: 169,247

[22] Filed: Mar. 16, 1988

[30] Foreign Application Priority Data

Mar. 18, 1987 [DE] Fed. Rep. of Germany ..... 3708704

[51] Int. Cl.[4] ..... B65D 88/54

[52] U.S. Cl. ..... 222/327; 222/386

[58] Field of Search ..... 222/325–327, 222/386, 391

[56] References Cited

U.S. PATENT DOCUMENTS

| | | | |
|---|---|---|---|
| 2,115,591 | 4/1938 | Sherbondy | 222/327 |
| 2,123,712 | 7/1938 | Clark | 222/326 X |
| 2,373,774 | 4/1945 | Murnane | 222/326 X |
| 2,752,073 | 6/1956 | Martin | 222/326 |
| 3,815,791 | 6/1974 | Clark | 222/326 |
| 4,022,355 | 5/1977 | Sabaka | 222/327 |
| 4,323,177 | 4/1982 | Nielsen | 222/386 |
| 4,366,919 | 1/1983 | Anderson | 222/327 X |

FOREIGN PATENT DOCUMENTS

| | | | |
|---|---|---|---|
| 229367 | 2/1925 | United Kingdom | 222/327 |

*Primary Examiner*—Joseph J. Rolla
*Assistant Examiner*—Steve Reiss
*Attorney, Agent, or Firm*—Diller, Ramik & Wight

[57] ABSTRACT

The conventional cartridges which contain adhesive or sealing compositions, involve the risk for the piston to adhere to the cartridge wall. Part of the composition is cured by air or moisture penetrating into the cartridge. To avoid such an adherence of the pistion, it is provided, according to the invention, that the piston (19) is first accomodated in a guide member (16) completely separately from the pasty composition (12). The composition (12) is included in container (11). Upon the removal of a cover (15), the guide member (16) may be connected to the container (11). The piston (19) may then be introduced into the container (11).

9 Claims, 3 Drawing Sheets

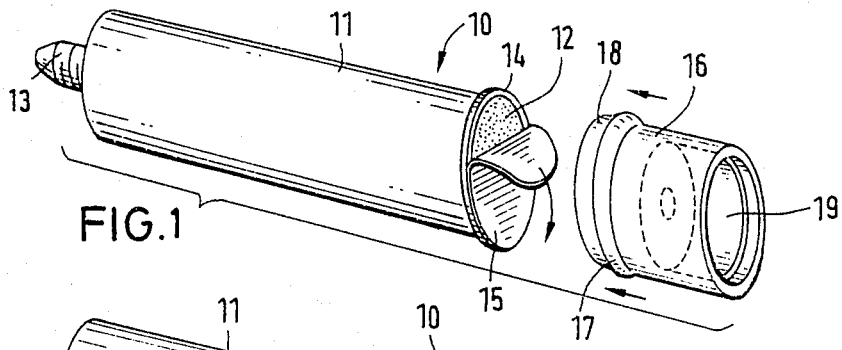
FIG.1
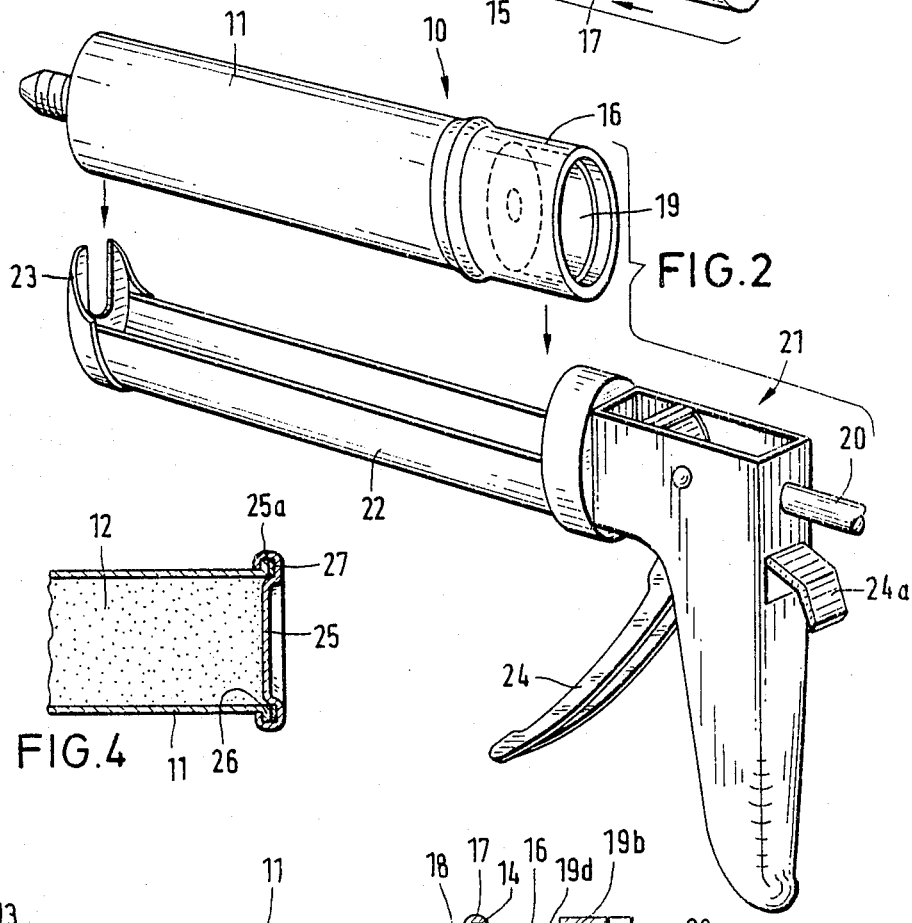
FIG.2
FIG.4
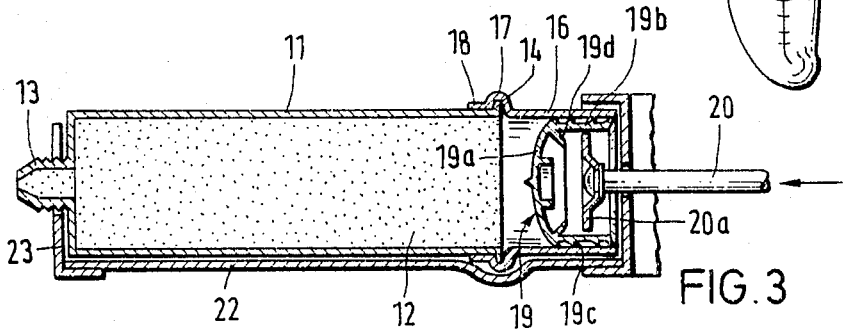
FIG.3

FIG.8
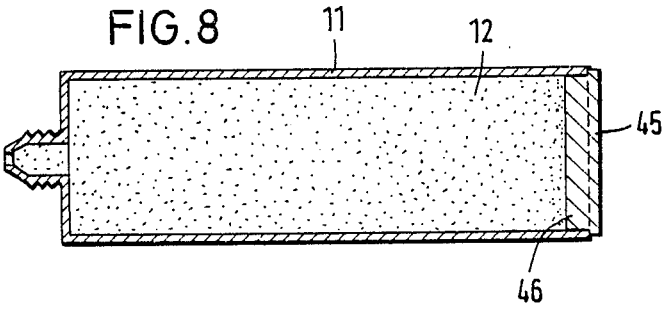
FIG.9
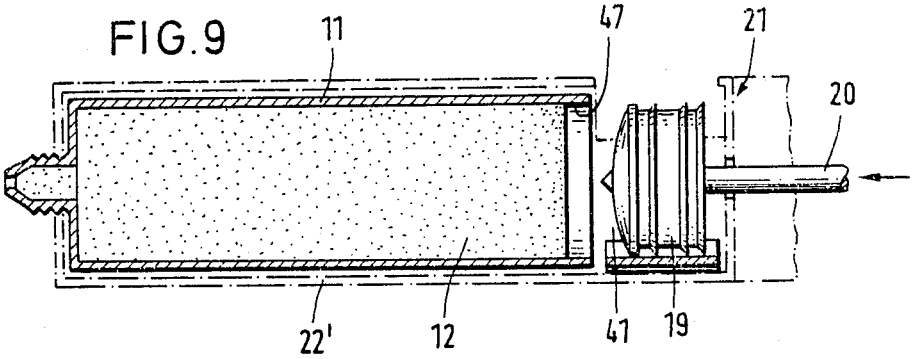
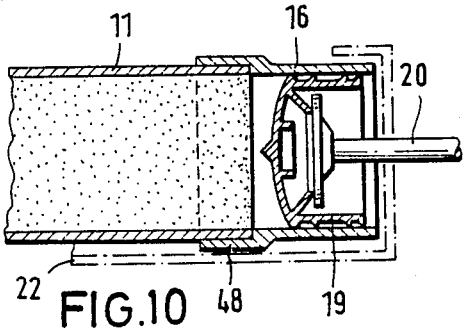
FIG.10
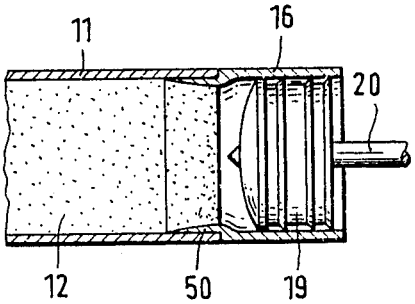
FIG.11
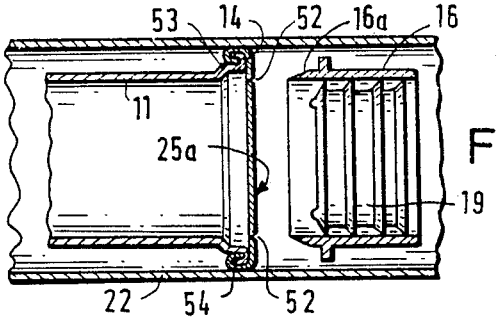
FIG.12

CARTRIDGE FOR PASTY MATERIALS

The invention relates to cartridges which consideration are used to store and squeeze out pasty substances, such as adhesives or sealants of silicone. The known cartridges consist of a tubular container having at its front end a threaded portion to connect thereto a nozzle, while its rear end is closed by a piston displaceable in the cartridge tube. In use, the cartridge is inserted into a pistol-type squeezing tool supporting the cartridge front end, while a pressure punch movable by actuating a trigger system, urges the piston to move it forward in the cartridge.

If the pasty composition is an adhesive or sealant hardening under the influence of air and/or humidity, there is a risk of a premature hardening if, in case of a longer storage, air or moisture penetrate through the piston which is an injection molded plastic part. Diffusion-tightness of such plastic parts is not sufficient to exclude, for longer periods, a reaction between the pasty composition and air or humidity. Above all, there is the risk for the piston circumference to be enclosed by a thin layer formed by part of the composition which easily cures so that, as a result thereof, the piston adheres to the inner wall of the cartridge. Said adhesion may be firm so that the manually or compressed-air operated squeezing tool will fail to overcome it. Further, there is the danger for the piston to adhere unilaterally and to be canted inside the cartridge under the action of the pressure punch, whereby the piston tightness is no longer ensured. Moreover, if the piston adheres to the cartridge, the piston and/or the cartridge may be destroyed with the attempt of squeezing out the substance.

To prevent pasty compositions inside the cartridge from coming into contact with air or humidity, there has been known a cartridge which, behind the piston, is closed by a tight cover (US 3 815 791), whose bottom, under the action of the pressure punch, tears off to slide intermediate said punch and the piston. While, by this means, air or humidity do not penetrate through the rearward end of the cartridge, the piston still risks to adhere to the cartridge wall, due to diffusion therethrough or by air occlusions.

In one conventional cartridge (US 3 503 542) a diffusion-tight sheet encompasses the end wall and the peripheral wall of the piston. In the area of the peripheral wall, said flat sheet forms folds which are filled by the pasty material thus bonding the sheet to the cartridge wall. If the piston separated by the sheet from the pasty composition, is advanced, the sheet will be torn and part of it is advanced in an undefined manner by the piston. Said separated sheet portion may move to a side of the piston which, on its total travel path, may be deformed and its tightness may be affected.

It is the object of the invention to provide a cartridge in which the adhesion of the piston to the cartridge wall is excluded without affecting the piston tightness.

Prior to the use of the cartridge of the invention, the piston is separated from the container, whose rearward end is closed by a diffusion-tight cover which, before the intended use, may be removed or destroyed in order to subsequently insert the piston into the container, said introduction being possible by guide means keeping the piston, during its forward travel, in axial alignment with the container. Before the cartridge is used, the cover is accessible from the outside, while the piston is still separated from the container. The piston cannot adhere to the container wall because it does not contact the container or the pasty composition. Only upon the removal or destruction of the cover, the piston contacts the pasty composition. If the cover is destroyed either by the guide means or by the piston, cover parts remain at the rearward container end where they are fixed. In other words, if the piston is radially deformed by destroyed cover parts, said deformation is temporary only until the piston is moved past the cover parts. Therefore, piston tightness may be impaired by said cover parts, but only over a limited distance of the displacement path of the piston. Preferably, the cover is detachable or susceptible to breaking thus ensuring that cover parts are not left in the travel area of the piston which may not be deformed by them at all accordingly. In a preferred embodiment of the invention a bipartite cartridge is preferably provided. The container including the pasty substance is elongated by the tubular guide member which, prior to the use of the cartridge, contains the piston, and prior to starting use, is applied to the rearward container end. In this case, the container may be completely filled to its brim or nearly to its rear brim with substance which, however, is totally absent in the rear guide member containing the piston. In the filling unit, only the containers are filled with pasty material, while the separately produced guide members comprising the inserted piston are added only later.

On the other hand, it is also possible, according to the invention, to design a one-piece cartridge not being filled to its brem, but comprising at its rear end an empty space which is filled by the cover. Upon the removal of the cover, the piston may be mounted into the empty space, whose wall serves as a guiding means.

The invention further relates to a squeezing tool for the cartridge. While the known squeezing tools are designed for receiving the cartridge together with the piston accommodated therein, the squeezing tool of the invention comprises, in addition to the cartridge holder, a piston bearing adapted to receive the piston and out of which the piston is movable by the pressure punch into the cartridge. Hence, cartridge and piston are mounted separately in the squeezing tool, while the cover closing the rear cartridge opening is either removed previously or it is destroyed when the piston is moved forward. It is important that the piston bearing is accurately aligned axially with the cartridge to ensure that the piston advanced by the pressure punch is safely introduced into the cartridges.

Some embodiments of the invention will be explained hereunder in detail with reference to the drawings in which:

FIG. 1 is a perspective view of a first embodiment of the cartridge when the container is opened.

FIG. 2 shows the mounting of the ready cartridge, into the squeezing tool,

Figure 5:
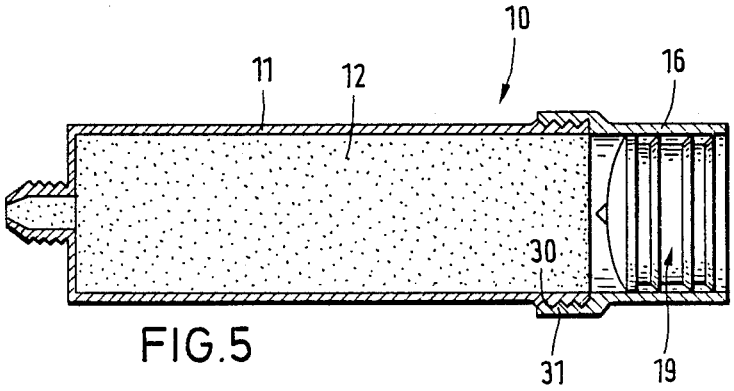
Figure 6:
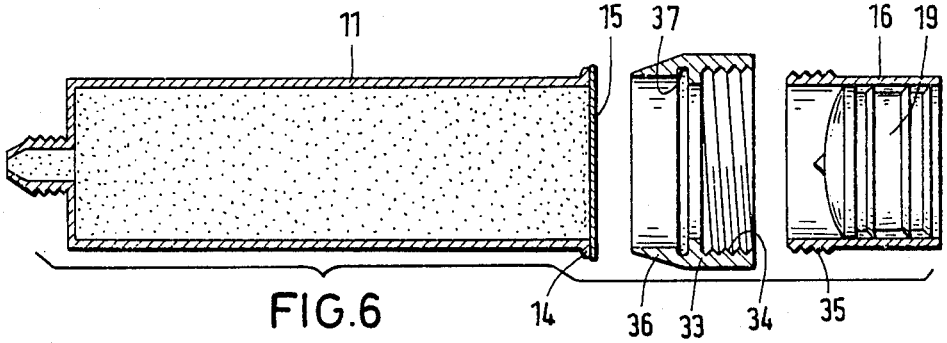
Figure 7:
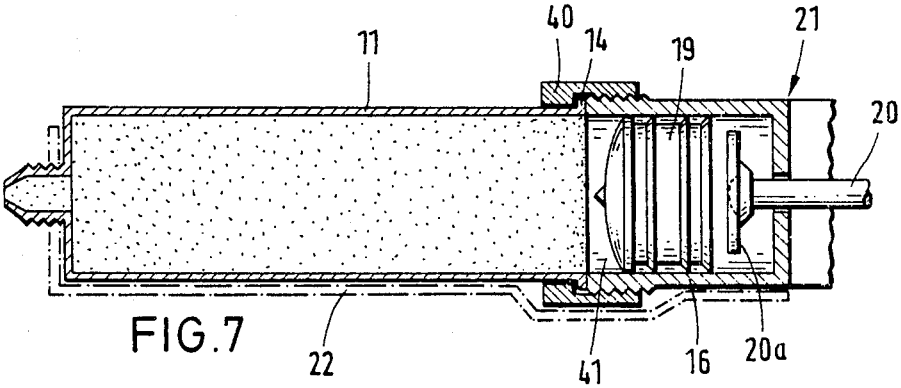

FIG. 3 shows a longitudinal section of the cartridge mounted in the squeezing tool, FIG. 4 is a longitudinal section of a modified embodiment of the cover, FIG. 5 is a second embodiment of the cartridge including a screw connection between container and guide member, FIG. 6 is another embodiment comprising an intermediate piece between container and guide member, FIG. 7 shows an embodiment in which the guide means is in the squeezing tool, FIG. 8 is a one-piece cartridge in which the guide means is provided at the container, FIG. 9 shows a cartridge of FIG. 8 mounted in a corresponding squeezing tool, FIG. 10 shows another embodiment of the cartridge mounted in a customary squeezing tool, FIG. 11 shows an embodiment of a bipartite cylindrical cartridge without laterally projecting elements, and FIG. 12 shows an embodiment similar to that of FIG. 3.

The illustrated cartridges are used to receive and squeeze out a pasty composition, e.g. an adhesive or sealant of silicone.

Cartridge 10 of the embodiment of FIGS. 1 to 3 includes an elongated cylindrical container 11 comprising the pasty substance 12 and whose front end is provided with a hollow, axially projecting thread portion 13 having a closed front end. If the substance 12 is squeezed out of the container, the front end may be separated from the container and a frusto-conical nozzle is screwed onto the thread portion 13.

The inner space of the container 11 is cylindrical. Its diameter is equal to that of the opening at the rear container end. The container 11 may be made of metal, coated cardboard or, preferably, of plastic. The rear container end is provided with a bead annularly enclosing the container opening and radially projecting outwardly. The container opening is closed by a cover 15 sealed or sealingly connected otherwise to the to the rear container end. As evident from FIG. 1, the cover 15 may be drawn away. It consists of a vapor-tight material, e.g. of a metal sheet or metal plate or of a composite material comprising a metal sheet, e.g. of aluminum. Container 11 is filled to its brim and without a hollow space with a pasty composition 12 whose rear end is limited without a hollow space by cover 15.

Further, the cartridge 10 includes the tubular guide member 16 whose front end may be slided onto the rear container end. The guide member 16 comprises a circumjacent annular reinforcing seam 17 which, in assembled condition of the guide member 16, covers the bead 14 of container 11 thus centering the guide member 16 on the container 11 and protecting it against axial displacement. In advance of the seam 17, there is a tubular and flexible guide portion 18 which, when slipped over the bead 14, is temporarily expanded to subsequently tightly enclose container 11.

Inside the tubular guide member 16, the piston 19 is accommodated. The area of the guide member 16 situated behind the reinforcing seam 17 has the same diameter as the inner space of container 11 thus allowing to move the piston 18, in the assembled condition shown in FIG. 3, out of the guide piece 16 into the container 11. To this effect, the guide member 16 is supported at the rear end of container 11. As obvious from FIG. 3, the front portion 18 of the guide member 16 has a diameter larger than that of the area behind the reinforcing seam 17.

In a manner known per se, the piston 19 is of a hollow nature. It comprises an outwardly curved end wall **19*a* adjoined by a cylindrical peripheral wall 19*b* and its rear end is open. The peripheral wall 19*b* is provided with circumjacent sealing lips 19*c*. From the transition of the end wall 19*a* to the cylindrical area 19*b*, a frustoconical rib 19*d* protrudes into the interior of the piston and abuts against disk 20*a* of the pressure punch 20 of the squeezing tool 21, in order to advance piston 19 for expelling the pasty composition 12. The squeezing tool 21 is a pistol, as usual, and it comprises an elongated cartridge holder 22 in which the cartridge 10 is positioned. At the front end of the cartridge holder 22, an abutment 23 is arranged for axially supporting the front end of cartridge 10. By actuating the trigger lever 24, the pressure punch 20 is advanced each time by a defined extent. A release lever 24*a*, if operated, allows to withdraw the pressure punch 20** so that the cartridge may be removed from the squeezing tool.

Prior to the use of the cartridge, the guide member 16 including the piston 19 is separated from container 11. Upon removal of cover 15 from container 11 (FIG. 1), the guide member is slipped for its lock-down onto the rear container end. The cartridge 10 assembled this way is mounted into the cartridge bearing of the squeezing tool 21 (FIG. 2). Subsequently, the trigger lever 24 is actuated whereby plate **20*a* of the pressure punch 20 is moved into the piston 19. During the following further operation of the trigger lever 24, piston 19 comes into contact with the pasty composition 12 to expel it out of the container 11. Since the piston 19 inside the guide member 16 does not contact the composition, it does not adhere. Due to the diffusion-tight cover 15**, the composition cannot cure before the container is opened.

Based on the embodiment of FIG. 2, a squeezing tool is disclosed in which the cartridge bearing 22 is trough-shaped thus allowing to mount the cartridge 10 from above into the bearing. Use may be also made of a squeezing tool having a tubular cartridge bearing into which the cartridge is inserted axially.

FIG. 4 shows an embodiment in which, in place of the flexible cover 15, a flanged cover 25 made of metal is provided. The rear end of the container 11 comprises a radially projecting flange 26 against which the cover 25 is placed. Border **25*a* of the cover 25 is beaded around flange 26. The cover region adjacent to the end side of flange 26 is provided with an annular seal 27** to ensure a hermetic cover closure.

The central area of the cover 25 is slightly recessed so that it adjoins the composition 12 without a hollow space. If the cover 25 is opened, the flanged border **25*a* may be either bent away or torn off. For the latter purpose, a weakening line is provided thus allowing to break the flanged border 25 off the cover 25**.

FIG. 5 shows the container 11 having a rear end with an external thread 30 on which is screwed the internal thread of an adapter 31 by which the guide member 16 is fixed to container 12. Again, the inner space of the guide member 16 adjoins that of the container 11 without a change in diameter. In the embodiment according to FIG. 5, the cover by which the container 11 was closed originally, has been already removed before the guide member 16 has been screwed on the container 11.

The guide member 16 has vent holes (not shown) to avoid air occlusions between piston 19 and material 12, said holes being spaced axially from the end of material 12 so that they are not closed by it if the piston 19 penetrates the material which first escapes in lateral and rearward direction. In fact, the receding material and the peripheral wall of the piston reach the vent holes nearly at the same time thus ensuring that the total air may escape. Corresponding venting means are also provided in the other embodiments although they are not disclosed there in detail.

FIG. 6 shows a coupling sleeve 33 having in its rear area an internal thread 34 into which an external thread 35 of the guide member 16 is screwed, the front end of the coupling sleeve 33 comprising a radially flexible range 36 adapted to be slipped over the bead 14 of container 10. In a groove 37 behind the flexible range 36, the bead 14 is fixed by engagement.

FIG. 7 shows a variant in which the guide member 16 forms part of the squeezing tool 21. Piston 19 is mounted from the front end into the guide member 16 into which, from the rear end, extends the pressure punch 20. Subsequently, upon the removal of its cover, container 10 is fixed with a thread 40 at the front end of the guide member 16 which, in this embodiment, is designed as a piston bearing 41 forming part of the squeezing tool and in which, always prior to the fixation of the container 11, piston 19 is placed.

In the embodiment of FIGS. 8 and 9, the cover 45 closing the container has an axial attachment 46 extending over some distance into the container 11 to fill its rear portion. Upon the removal of the cover 45 (FIG. 9), the rear end portion 47 free from material 12 forms the guide means for the introduction of the piston 19 into the container 11 which need not be provided with a bead or annular flange, while its outer surface may be cylindrical or may comprise radially projection elements. Hence, the cartridge bearing 22 of FIG. 9 is a tube enclosing the container 11 at a close distance. The rear end of the cartridge bearing 22' is designed as a piston bearing 41 receiving the piston 19 in axial alignment with the container 11. Said piston 19 may be mounted through the radial opening of the piston bearing 41 to lie between the pressure punch 20 and the rear end of container 11. With the advancing pressure punch 20, the piston will be inserted into the rear area 47 of the container 11.

The embodiment of FIG. 10 again provides a guide member 16 which is placed on the rear end of the container 11 filled to its brim, said guide member 16 accommodating piston 19 and comprising a sleeve nut 48 loosely applied to the rear container end, the guide member 16 being axially supported by container 1 and a protection against its removal from container 11 not being required because, in use, the squeezing tool does not exert forces tending to withdraw the guide member 16 from the container 11. The external surface of container 11 is cylindrical without any projecting elements.

Looking now at the variant shown in FIG. 11, the guide member 16 containing piston 19 is provided with an annular projection 50 protruding into the interior of container 11 and adjoining closely its inner wall, the wall thickness of the projection continuously decreasing towards the front end so that the inner wall of projection 50 continuously merges with that of the container 11. While the internal diameter of the guide member behind projection 50 is equal to that of container 11, the projection 50 forms a constriction through which piston 19, in being deformed, must be moved. The peripheral surfaces of container 11 and guide member 16 are adjoined in flush without projecting elements so that the total length of cartridge 10 has a cylindrical outer contour.

It is also possibly to cut up, by means of the sharp front edge of projection 50, the cover made of sheet material when the guide member 16 is slipped on container 11. To this effect, the front edge of the guide member 16 may be chamfered thus initiating, when the guide member is inserted, the severing operation at one point and continuing it with its further introduction.

In contradistinction to the above disclosed embodiment, it is possible to design a cover which need not be removed or destroyed prior to the introduction of the piston into the container. Further, the cover may be pierced or torn open by a spike provided at the front end of the piston; if so, the cover residues remain at the rear container end and are not moved in front of the piston.

According to FIG. 12, the end of container 11 comprises an expansion 53 in advance of the flanged border. If the guide member 16 is pierced by the blade edge **16*a* of the guide member 16, the cover 25*a* is cut off at the weakening line 52. Piston 19 may be moved without deformation into the container. The outer contour of the cartridge of this embodiment is not cylindrical. The flanged border 54 not being larger than in case of commercial cartridges, use may be made of current processing devices with usual cartridge holders 22. Contrary to FIG. 3**, the container of this embodiment is of a more slender type.

What is claimed is:

1. A squeezing tool comprising a cartridge holder, a cartridge, and a separate tubular guide member housing an internal piston;

said cartridge holder including a cartridge-receiving body having opposite dispensing and force-applying ends, a shoulder at said dispensing end, a piston plate carried by a rod mounted for sliding movement at said force-applying end;

said cartridge including a cylindrical container, pasty material in said cylindrical container, said cylindrical container having a discharge end and an opposite force-applying end;

said tubular guide member having first and second opposite end portions, means for connecting said tubular guide member first end portion to said cylindrical container force-applying end prior to the collective insertion of the tubular guide member and the cylindrical container into the cartridge-receiving body, said internal piston being spaced from an external to said opposite force applying end of said cartridge, said tubular guide member and connected cylindrical container being positioned in said cartridge-receiving body with said cylindrical container discharge end abutting said shoulder and said tubular guide member second end portion being contiguous said cartridge-receiving body force-applying end and in axial alignment with said piston plate and rod;

means for moving said rod toward said shoulder to move said piston plate into and through said tubular guide member and into contact with said piston thereby moving said piston in a dispensing direction into the force applying end of said cylindrical container to dispense the pasty material therefrom, and said piston plate and rod being further movable inn a second opposite direction of retraction bringing said piston plate out of contact with said piston incident to the termination of a dispensing operation.

2. The squeezing tool as defined in claim 1 wherein said connecting means are screw threads.

3. The squeezing tool as defined in claim 1 wherein said connecting means is a clamping connection at said container free-applying end.

4. The squeezing tool as defined in claim 1 wherein said force applying end of said container includes a removable cover.

5. The squeezing tool as defined in claim 1 wherein said tubular guide member and cylindrical container have internal cylindrical surfaces of essentially the same diameter.

6. The squeezing tool as defined in claim 4 wherein said pasty material completely fills said cylindrical container without headspace adjacent said cover.

7. The squeezing tool as defined in claim 4 wherein said pasty material completely fills said cylindrical container without headspace adjacent said cover, and said cover is a sheet.

8. The squeezing tool as defined in claim 4 wherein said pasty material completely fills said cylindrical container without headspace adjacent said cover, and said cover has a cup-shaped recessed portion extending into said container force-applying end.

9. A squeezing tool comprising a cartridge, a piston guide, and a cartridge holder, cartridge holder including a cartridge-receiving body having opposite dispensing and force-applying ends, a shoulder at said dispensing end, a piston plate carried by a rod mounted for sliding movement at said force applying end, said piston guide enclosing, a separate piston having an exterior maximum diameter, said cartridge including a cylindrical container, pasty material in said cylindrical container; said cylindrical container having a discharge end, an opposite force-applying end and an internal diameter substantially equal to the piston maximum diameter; a removable cover normally closing said opposite force-applying end and projecting a predetermined axial distance therein whereby upon the removal of said cover an internal volume of predetermined axial length is provided at said force-applying end and is devoid of pasty material, said cylindrical container being insertable in said cartridge-receiving body with said cylindrical container discharge end abutting said shoulder and said internal volume opening axially toward said piston plate, said piston guide being insertable between said piston plate and said internal volume when said cartridge is in position in said cartridge holder, said piston being spaced from said force-applying end of said cartridge, means for moving said rod toward said shoulder to move said piston plate against said piston and moving said piston from said piston guide and progressively into said internal volume of said container whereby the internal diameter thereof cooperates with said piston maximum diameter to guide said piston during movement thereof in a dispensing direction into said cylindrical container to dispense the pasty material therefrom, and said piston plate and rod being further movable in an opposite retracting direction incident to the termination of a dispensing operation.

* * * * *